US005279051A

United States Patent [19]

Whatley

[11] Patent Number: 5,279,051

[45] **Date of Patent: * Jan. 18, 1994**

[54] FOOTWEAR CUSHIONING SPRING

[76] Inventor: Ian Whatley, 240 Donington Dr., Greenville, S.C. 29615

[ * ] Notice: The portion of the term of this patent subsequent to Oct. 29, 2008 has been disclaimed.

[21] Appl. No.: 829,470

[22] Filed: Jan. 31, 1992

[51] Int. Cl.[5] ..... A43B 13/00

[52] U.S. Cl. ..... 36/25 R; 36/27; 36/71; 36/114; 36/7.8

[58] Field of Search ..... 36/27, 28, 29, 38, 35 R; 35 B; 71, 114, 7.8

[56] References Cited

U.S. PATENT DOCUMENTS

| | | | |
|---|---|---|---|
| 224,937 | 2/1880 | Mintzer . | |
| 354,986 | 12/1886 | Martin | 36/38 |
| 532,429 | 1/1895 | Rogers | 36/28 |
| 682,940 | 9/1901 | Keller | 36/38 X |
| 2,444,865 | 7/1948 | Warrington | 36/38 |
| 2,508,318 | 5/1950 | Wallach | 36/38 |
| 2,555,654 | 6/1951 | Ostrom | 36/38 |
| 2,953,861 | 9/1960 | Horten . | |
| 3,777,374 | 12/1973 | Hendricks | 36/38 |
| 3,834,046 | 9/1974 | Fowler . | |
| 3,886,674 | 6/1975 | Pavia | 36/38 |
| 4,128,950 | 12/1978 | Bowerman et al. . | |
| 4,297,796 | 11/1981 | Stirtz et al. . | |
| 4,342,158 | 8/1982 | McMahon et al. | 36/38 X |
| 4,372,058 | 2/1983 | Stubblefield . | |
| 4,402,146 | 9/1983 | Parracho et al. . | |
| 4,449,307 | 5/1984 | Stubblefield . | |
| 4,451,994 | 6/1984 | Fowler . | |
| 4,492,046 | 1/1985 | Kosova . | |
| 4,546,555 | 10/1985 | Spademan . | |
| 4,566,206 | 1/1986 | Weber . | |
| 4,592,153 | 6/1986 | Jacinto . | |
| 4,771,554 | 9/1988 | Hannemann . | |
| 4,881,329 | 11/1989 | Crowley . | |
| 4,910,884 | 3/1990 | Lindh et al. . | |
| 4,924,605 | 5/1990 | Spademan . | |
| 5,060,401 | 10/1991 | Whatley | 36/114 X |
| 5,138,776 | 8/1992 | Levin | 36/38 |

FOREIGN PATENT DOCUMENTS

| | | |
|---|---|---|
| 103041A | 3/1984 | European Pat. Off. . |
| 3415705A | 10/1985 | Fed. Rep. of Germany . |
| 2507066 | 12/1982 | France . |

*Primary Examiner*—Steven N. Meyers
*Assistant Examiner*—Ted Kavanaugh
*Attorney, Agent, or Firm*—Lyon & Lyon

[57] ABSTRACT

An article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The midsole is provided with an external cushioning spring. This spring includes one or more angled strips of resilient elastic material. One end of a strip is fixed on the surface of the midsole or outsole at a location at least 3 mm below the upper surface of the midsole. The other end of the strip is fixed on the surface of the midsole or upper at least 3 mm vertically above the location at which the other end is fixed. The external cushioning spring is fixed in a manner such that a vertical force on the footwear created by a wearer of the footwear striking the outsole on a solid surface causes the angled strip to bend between or at its ends, thereby absorbing a portion of the force.

71 Claims, 7 Drawing Sheets

FOOTWEAR CUSHIONING SPRING

BACKGROUND OF THE INVENTION

This invention relates to cushioning devices for footwear.

Stubblefield, U.S. Pat. No. 4,372,058, describes a shoe sole having a tread which defines a longitudinally and/or laterally oriented concavity. The lower extremities of the sole are formed by downwardly and outwardly disposed flexible lugs which cushion the foot of a wearer against impact loads. Stubblefield, U.S. Pat. No. 4,449,307, describes a basketball shoe sole having a central longitudinally arranged support wall.

Parracho et al., U.S. Pat. No. 4,402,146 disclose a sole having side tabs extending from the outsole to the shoe upper. These tabs are designed to stabilize the midsole and reduce ankle fatigue.

Stirtz et al., U.S. Pat. No. 4,297,796, describe an inner sole member formed of an open mesh web. The web includes elongated interwoven stretch resistant strands disposed at oblique angles relative to the longitudinal axis of the shoe. The strands act as force transmitters with respect to the sole member.

Bowerman et al., U.S. Pat. No. 4,128,950, describe a multilayered athletic shoe sole formed of synthetic plastic foam positioned between a hard outsole and an upper. A lateral extending heel stabilizer plate of solid plastic material is added to improve lateral stability.

Fowler, U.S. Pat. Nos. 4,451,994 and 3,834,046 disclose various designs for a midsole, e.g., replacing a conventional cushioning midsole foam with a ribbed, resilient, internal diaphragm.

Kosava, U.S. Pat. No. 4,492,046 describes a running shoe having a longitudinal slot in its sole in which an internal spring wire is inserted.

Crowley, U.S. Pat. No. 4,881,329 describes an athletic shoe having an internal spring in its midsole.

Weber, U.S. Pat. No. 4,566,206 describes an internal spring provided in a heel of a shoe.

Jacinto, U.S. Pat. No. 4,592,153 describes internal Z-shaped plates within the heel or other portions of a shoe.

Schuster, DE3415-705-A describes a wire spring arrangement under a shoe sole.

Mintzer, U.S. Pat. No. 224,937 describes an engineer's shoe having a spring.

Horten, U.S. Pat. No. 2,953,861 describes resilient jumping shoes.

Hannemann, U.S. Pat. No. 4,771,554 describes an internal heel insert.

Barbeau, FR 2507-066 describes a spring in the sole of a training shoe.

Schnell, EP103-041-A describes a sports shoe with a spring sole.

Lindh et al., U.S. Pat. No. 4,910,884 describes a shoe sole having a spring apparatus.

Spademan, U.S. Pat. Nos. 4,546,555 and 4,924,605 describe shoes having shock absorbers.

SUMMARY OF THE INVENTION

The invention features an article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The term "midsole" is used, as the term is commonly used, to describe a cushioning device placed within the footwear upon which a foot is positioned during use of the article. Generally, such midsoles are provided in athletic shoes, but not in those shoes generally worn in conventional business use. The midsole is also provided with an external cushioning spring. This spring includes one or more angled strips of resilient elastic material. One end of one such strip is fixed on the surface of the midsole or outsole at a location at least 3 mm below the upper surface of the midsole. The other end of the strip is fixed on the surface of the midsole or upper at least 3 mm vertically above the location at which the one end is fixed. The external cushioning spring is fixed in a manner such that a vertical force on the footwear created by a wearer of the footwear striking the outsole on a solid surface causes the angled strip to bend between its ends, thereby absorbing a portion of the force.

The surfaces discussed above include portions of the shoe which are normally visible (were it not for the presence of the external spring) from the outside of the shoe. They also include molded (or other) external indentations designed to allow the external spring to fit beneath, above or within a portion of the midsole (as shown in the figures herein). Thus, a surface is generally defined by a connecting wall between the upper and lower generally horizontal perimeters of the midsole or outsole (ignoring any portion of overlap of the outsole over the midsole, or midsole over the upper). A surface of an outsole, midsole and upper lie in the same general vertical plane (again ignoring overlapping portions of these components) and the external spring extends from the shoe toward this plane or beyond the plane. In one example it may actually be attached to the shoe at this plane. Preferably, it is attached to the shoe inward of this plane and extends to the plane and only 1–4 mm beyond.

The term "angled" is used in a broad sense in this application to encompass any shape of material having a bended portion which acts to absorb a portion of a vertical force applied to two ends of that bended portion. When the points of attachment are made as described, the angle or bend can be oriented in any direction that allows bending to occur, and can thus be altered for pleasing cosmetic effect. For example, the bending may occur into or away from a midsole or parallel to the surface of the midsole. Thus, it includes use of an angled strip, as shown in the drawings, having a less resilient material (e.g., air or foam) filling in any gap between the two ends of the bended portion e.g., to give the appearance of an unbent strip of material. Such an angled strip is functionally equivalent to those shown in the drawings. For example, in one embodiment (shown in FIGS. 8A–8C) the spring may be a ring-shaped structure inserted within a cylindrical indentation in the midsole.

The phrase "vertically above" includes not only a structure in which the ends of the strip are fixed directly above one another, but also a structure in which one end is vertically displaced, but not directly above the other end.

The term "external" refers to a spring element that does not entirely replace a portion of a normal midsole across the entire width or length of a shoe, as do those internal spring items described in the art cited above. Rather, the element is located only on one side (or at one end) of a shoe and may extend inward from the shoe perimeter to some extent (e.g., about 2-3 cm). Thus, the element is designed to provide resilience to only one side or one part of a shoe, especially in the areas indicated in the drawings (e.g., those areas referred to as the arch and medial aspect). The term indicates that no midsole covers the whole of external surface of the spring (although outsole may do so if desired).

In preferred embodiments, one end of the spring is fixed to the footwear at a junction between the outsole and the midsole, or at a junction between the midsole and the upper; and the spring includes an extension formed generally perpendicular to the angled strip and adapted for insertion between the outsole and midsole, or the midsole and upper; most preferably the extension is fixedly connected to the angled strip.

In other preferred embodiments, one end of the spring is fixed to the footwear on the top surface of the outsole or bottom surface of the upper; the angled strip is in the form of a U, V, Z, O, S, Y and W or hairpin shape, and is fixed to the footwear at a heel portion; the external cushioning spring includes a heel cup attached to the angled strip, and is fixed to the footwear by adhesive; both of the ends of the angled strip are attached to the midsole; the footwear includes a plurality of separate, adjacent or integrally combined external cushioning springs; the angled strip is applied along its length to the surface of a normal midsole; the angled strip is attached in the ball region of the footwear; and the angled strip is formed of plastic, rubber, or metal or carbon fiber.

In another preferred embodiment, the midsole is provided with an indentation (compared to a normal midsole) which allows the spring to be fixed beneath one part of a foot within the shoe, e.g., on one or both sides, preferably toward the end of the shoe, such as in the medial aspect, or even in the heel.

In a related aspect, the invention features a method for making an article of footwear. The method includes the steps of providing an upper, an outsole, and a midsole. The midsole has an upper surface upon which a sole of a foot is positioned during use of the article. The method includes providing an external cushioning spring including an angled strip of resilient elastic material. The method features fixing the midsole between the upper and the outsole; fixing one end of the angled strip on the surface of the midsole or outsole at a location at least 3 millimeters below the upper surface of the midsole; and fixing the other end of the angled strip on the surface of the footwear at least 3 millimeters vertically above the location at which the one end is fixed. For example, the method features first fixing one end of the angled strip on the surface of the midsole or outsole at a location at least 3 millimeters below the top surface of the midsole; and then fixing the other end of the angled strip on the surface of the footwear at least 3 millimeters vertically above the location at which the one end is fixed; and finally fixing the midsole between the upper and the outsole.

In preferred embodiments, the method includes providing a spring having an extension formed generally perpendicular to the angled strip, and adapted for insertion between the outsole and midsole, or between the midsole and the upper; and at least one of the fixing steps includes fixing one end of the angled strip to the article of footwear by adhesive. Generally, the spring is formed as a planar piece of material or formed to follow the contours of the footwear, those contours include the plane generally defined by the side wall of the outsole, the outer surface of the upper, or the side wall of the midsole.

This invention provides an article of footwear, generally a shoe, which is designed to absorb some of the forces caused by the wearer of the footwear landing or moving quickly during walking, running, or other sports activities. Generally the footwear is provided with one or more curved, angled or zigzagged pieces (collectively termed "angled" in this application) of resilient elastic material connected to the footwear at two points. The lower point is 3 millimeters or more below the plane of the sole of the foot in the footwear, and the upper point is at least 3 millimeters above this point, and preferably at the level of the plane of the sole of the foot. When a vertical or near-vertical force is applied to the footwear the two points at which the resilient material is connected are pushed closer together. This causes the angled portion of the material to be bent and absorb a portion of the energy. As the foot lifts away from the ground, the element will return to its original shape and thus returns some of the stored energy to the wearer. Optimum results are observed when the spring portion is placed at the heel and/or under the metatarsal heads. Such locations provide most efficient protection from foot-ground reaction forces, and for energy return. In addition, by placing the spring on the surface of the outsole, midsole, and upper it provides a stabilizing effect on the gait of the wearer. Thus, it helps to prevent the foot from rolling to the outside or inside edge of the footwear. In this way the spring is an aid to persons suffering from pronation.

The spring is particularly advantageous when used on athletic footwear for persons running at high speeds, e.g., during races, and for persons who constantly jump up and down, e.g., in basketball. Because of the shock-absorbing effect of the springs the vertical impact forces associated with such sports are reduced, and thus chronic and acute injuries to the lower limbs prevented or reduced. When used to prevent pronation of the user, it is desirable to place springs only on one side of the footwear, rather than on both sides. Alternatively, springs having differing resilience may be placed on either side to provide protection against vertical forces applied to the foot, and also prevent pronation of the wearer.

Applicant provides an efficient method by which extra support can be provided within a shoe outsole or midsole at specific locations. Prior to this invention either the whole midsole or a significant portion of it was replaced by internal support elements (as described in the cited art above), that is, an element which extended the whole width or length of a shoe was provided. Such elements do not provide the specific support desired in this invention and are difficult to manufacture. In contrast, the present invention provides an external spring which is readily inserted during manufacture onto a shoe, either onto a standard outsole or midsole, or onto a modified outsole or midsole. Since the spring is external it is also advantageous in allowing blemishes produced during manufacture to be obscured (e.g., by a lip of the spring) to obtain a functional and good looking shoe. In addition, because it is external, manufacture is simple, and the final product of uniform quality.

If a lip is not desired, standard manufacturing techniques may be used to cover the external spring with a portion of the outsole and thus avoid blemishes. It is preferred, however, to keep the spring visible since it then allows elaborate designs to be displayed.

Other features and advantages of the invention will be apparent from the following description of the preferred embodiments thereof, and from the claims.

DESCRIPTION OF THE PREFERRED EMBODIMENTS

The drawings will first briefly be described.

DRAWINGS

FIG. 1A is an isometric side view of an athletic shoe having springs in the heel and ball regions of the foot; FIG. 1B is an isometric view of the spring shown in the ball region; FIG. 1C is an isometric view of the spring shown in the heel region; FIGS. 1D and E are cross-sectional views taken at Y and X in FIG. 1A, respectively;

STRUCTURE

Figure 1A:
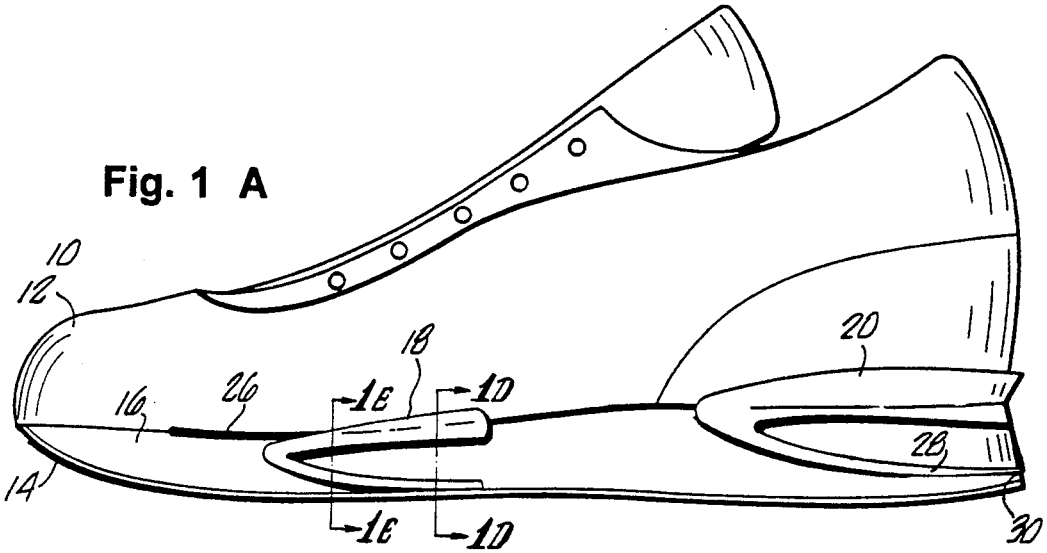

Referring to FIG. 1A, an athletic shoe 10 is formed by standard procedure having an upper 12, an outsole 14 and a midsole 16. Also provided is a ball spring 18 in the ball region of the shoe, and a heel spring 20 in the heel region of the shoe.

Figure 1C:
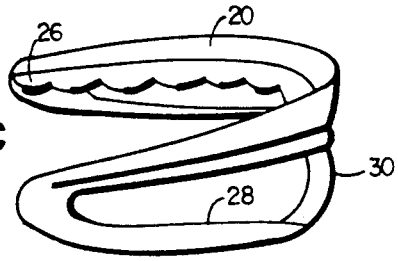
Figure 1B:
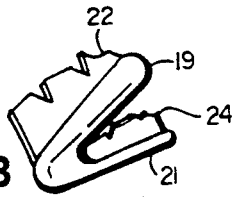

Referring to FIG. 1B, ball spring 18 is formed generally in the shape of a hairpin with two prongs 19, 21 lying along a plane (not shown) of the outsole and midsole. Also provided are two tabs 22, 24 extending from the hairpin generally perpendicularly from this plane. Tabs 22 and 24 are generally planar and adapted for insertion between midsole 16 and either outsole 14, or upper 12. These tabs act to hold spring 18 on the surface of shoe 10. Lower tab 24 may be positioned between midsole 16 and outsole 14, or at any other point in midsole 16 or in outsole 14, which is at least 3 millimeters below a plane 26 on which the foot of a wearer of shoe 10 lies. If desired, tabs 22 and 24 can be removed and hair spring 18 connected to shoe 10 by adhesive, e.g., glue or heat.

Referring to 1C, heel spring 20 is provided with a tab 26, again formed generally perpendicular to the inner surface of heel spring 20 and adapted for insertion between upper 12 and midsole 16 in the heel region. Lower portion 28 of heel spring 20 is connected to shoe 10 by a generally flat tab 30 which is positioned and held with midsole 16 or between midsole 16 and outsole 14. Alternatively, tab 30 may be connected to the outer surface of shoe 10 by adhesive. Tab 30 is connected at a location at least 3 millimeters below plane 26, i.e., where the heel of the wearer contacts the midsole.

Referring to 1D and 1E, sections of ball spring 18 are shown. Prongs 19, 21 and inwardly extending tabs 22, 24 are shown in their relative positions between midsole 16 and outsole 14, between upper 12 and midsole 16, and within midsole 16.

The above springs are formed of material which absorbs energy when bent but returns to its original shape, or close to its original shape, after bending. Appropriate materials include plastic such as surlyn, hytrel, nylon, PVC, PU, spring steel, Delrin, TPU, PEBAX, Graphite, Kevlar, aluminum, or rubber (synthetic or natural). The spring and midsole or outsole may be connected by heat, either with or without the tabs present, for example, during injection molding. Although the Figures show only one side of a shoe, it is preferred that the springs be provided on both sides of a shoe unless designed to prevent pronation or similar problems. The shoes are formed by any standard procedure, with the spring being connected either by adhesive or by tabs as described above. If tabs are used these may be sewn directly into portions of the shoe, for example between the upper and the midsole or between the midsole and outsole. Where the spring is adjacent the midsole the midsole may be formed in a mold to include appropriate indentations to allow ready insertion of the external spring.

OTHER EMBODIMENTS

Figure 2:
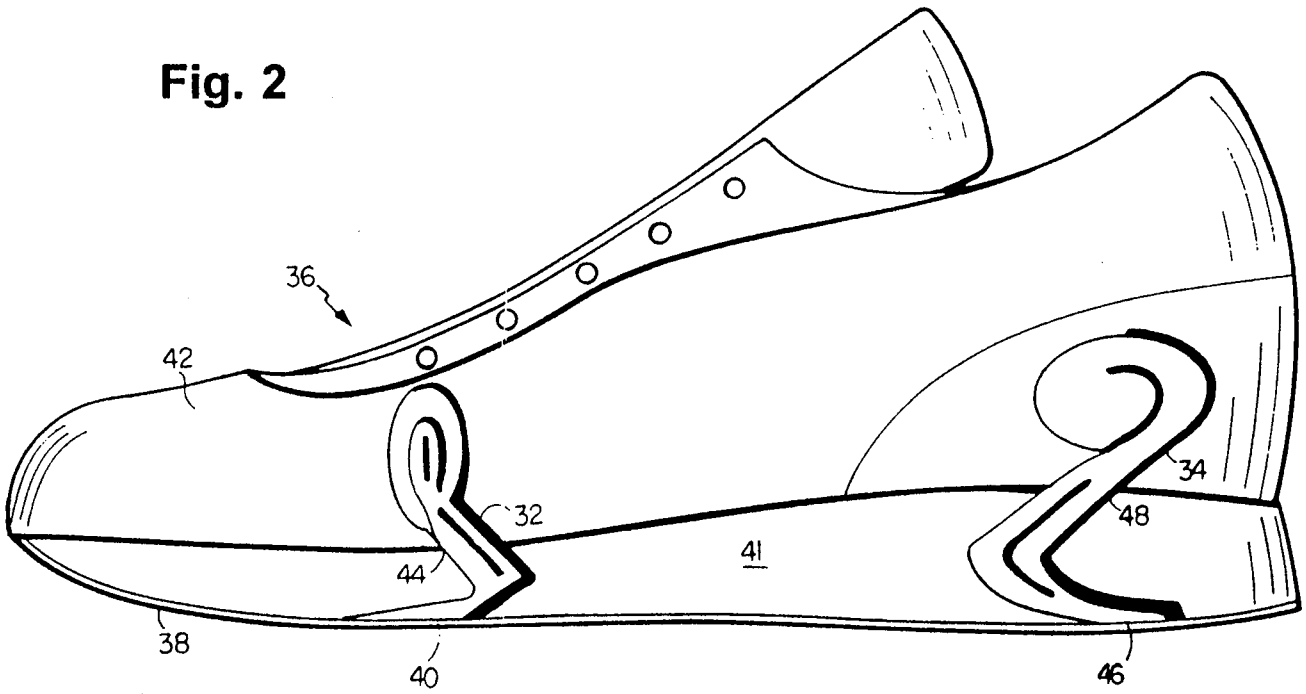
FIG. 2 is an isometric side view of an athletic shoe having springs in the ball and heel regions.

Other embodiments are within the following claims. For example, referring to FIG. 2, there are shown springs 32 and 34 which are adhesively fixed to a shoe 36 at outsole 38 in ball region 40 and heel region 46. Heel spring 34 is also connected at a location 48 to midsole 41, and ball spring 32 at a location 44 to midsole 41. As can be seen in this embodiment the only requirements of springs useful in this invention are that they are connected at 2 points to the shoe with the lower point being at least 3 millimeters below the plane of the foot of the wearer, and the other point being at least 3 millimeters above that point in the midsole or upper. Between the two points of connection must be an angled piece of material which will bend between the two points when subjected to a vertical force applied to the two points. The remainder of the spring may or may not be fixed to the shoe, and may have any desired design, thus providing aesthetic qualities to the shoe. Such design may extend to the shoe upper.

Figure 3A:
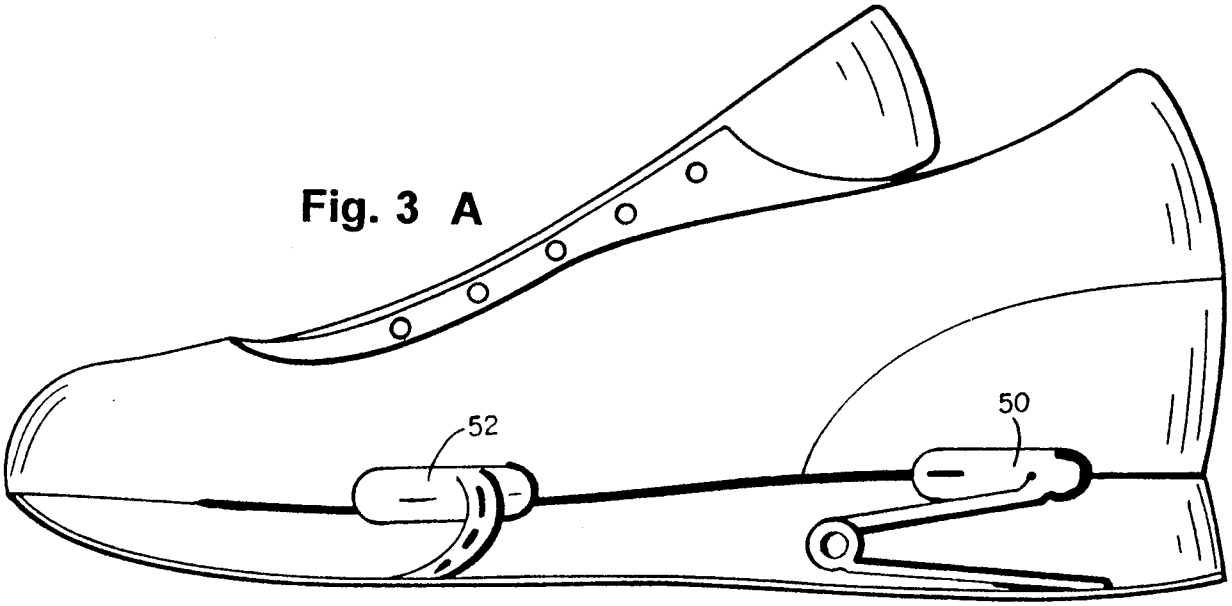
FIGS. 3A–3F, 4A–4F, 5A–5D, 6A and 7A–7B are diagrammatic representations of various other embodiments of springs useful in the invention.
Figure 3B:
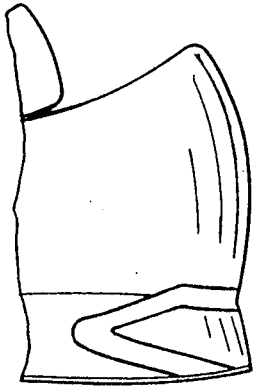
Figure 3C:
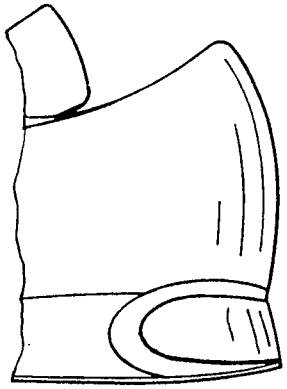
Figure 3D:
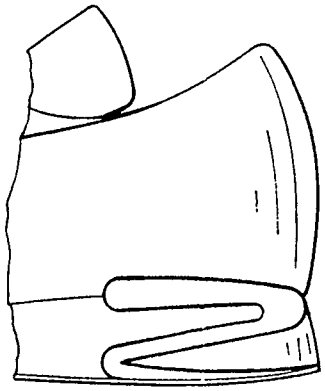
Figure 3E:
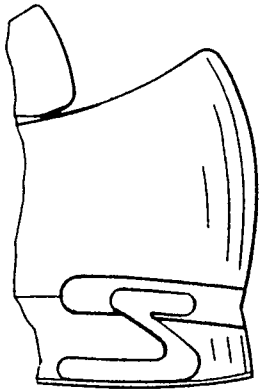
Figure 3F:
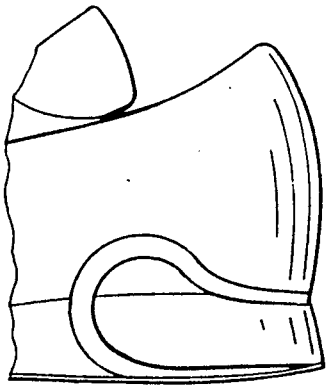

Referring to FIGS. 3A–3F there are shown seven other embodiments of springs suitable for use in this invention. In FIG. 3A, there is shown a spring 50 in the heel region shaped in the form of a safety pin, and connected between the midsole and upper and on the surface of the midsole by a tab (not shown) formed perpendicularly to the inner surface of spring 50. In the ball region is shown a spring 52 fixed by one or more perpendicular tabs (not shown) between the midsole and upper, midsole and midsole, or between the midsole and outsole, having a generally boomerang-shaped spring attached thereto. Referring to FIGS. 3B, 3C, 3D, 3E, and 3F, there are shown various heel springs (e.g., 54, 56) formed as V-, U-, Z-, J-, S- and other shapes, respectively.

Figure 4A:
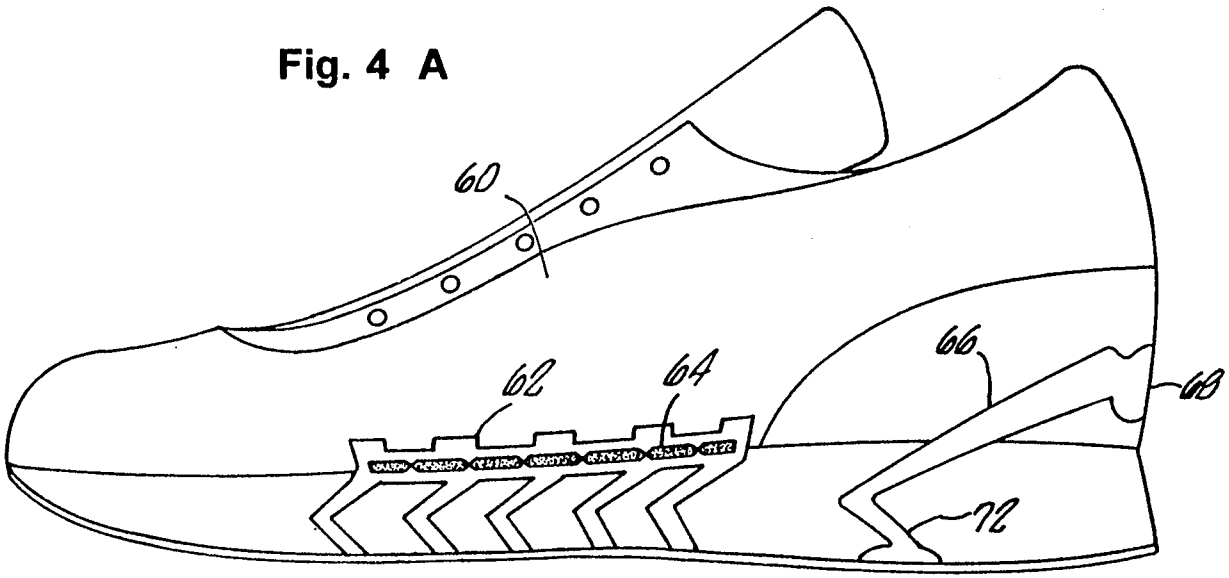
Figure 4F:
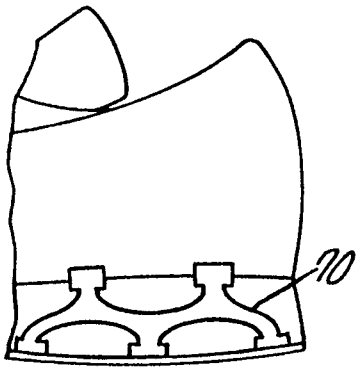
Figure 4E:
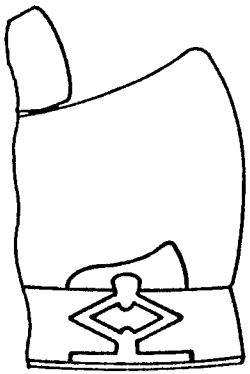
Figure 4D:
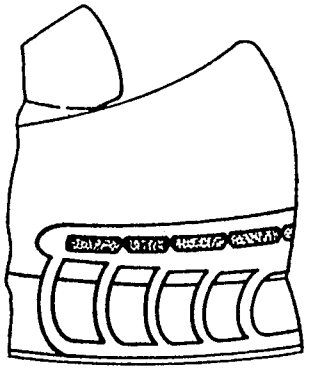
Figure 4B:
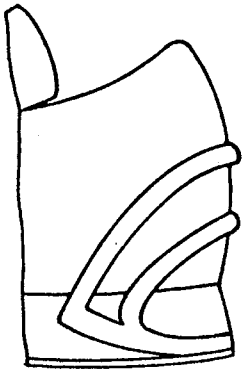
Figure 4C:
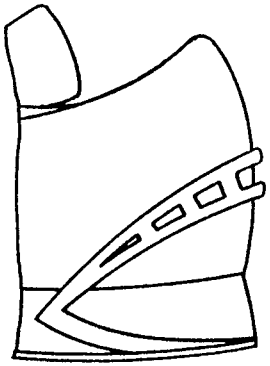

Referring to FIG. 4A, a side elevation of a shoe with a spring 62 attached to upper 60 by stitching 64 is shown. Another spring 68 fastened to upper 60 has a first prong 66 and second prong 72 (also present on the far side of the shoe, not shown). FIGS. 4B, 4C, 4D, and 4E show single or multiple arrangements of prongs and tabs which function as footwear cushioning springs. For example, FIG. 4F shows a spring 70 in the shape of a multi spring configurations.

Figures 5A, 5B, 5C, 5D:
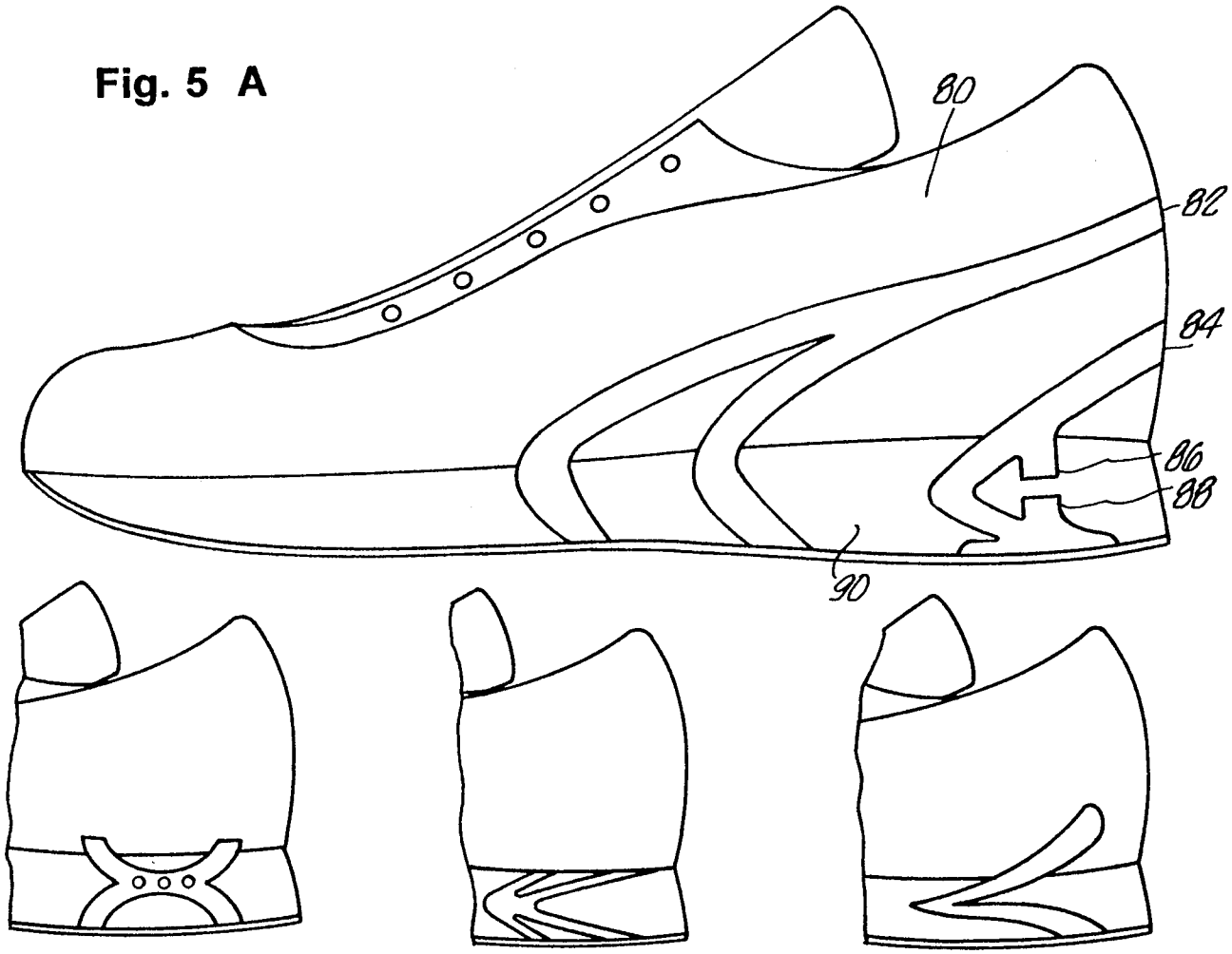

Referring to FIG. 5A, spring 82 is attached near the top of upper 80 for added support of the upper. Spring 84 includes extensions 86 and 88 to limit the range of bending of spring 84. FIGS. 5B, 5C, and 5D further illustrate the application of external springs in the heel area of footwear, these springs can also be attached at other locations on midsole 90.

Referring to FIGS. 6A-6E, there are shown three springs 100, 102, and 104. Spring 100 is a combination of three Z-shaped springs. Spring 102 is C-shaped. Spring 104 has a multi shape configurations.

Figures 6A, 6B, 6C, 6D, 6E:
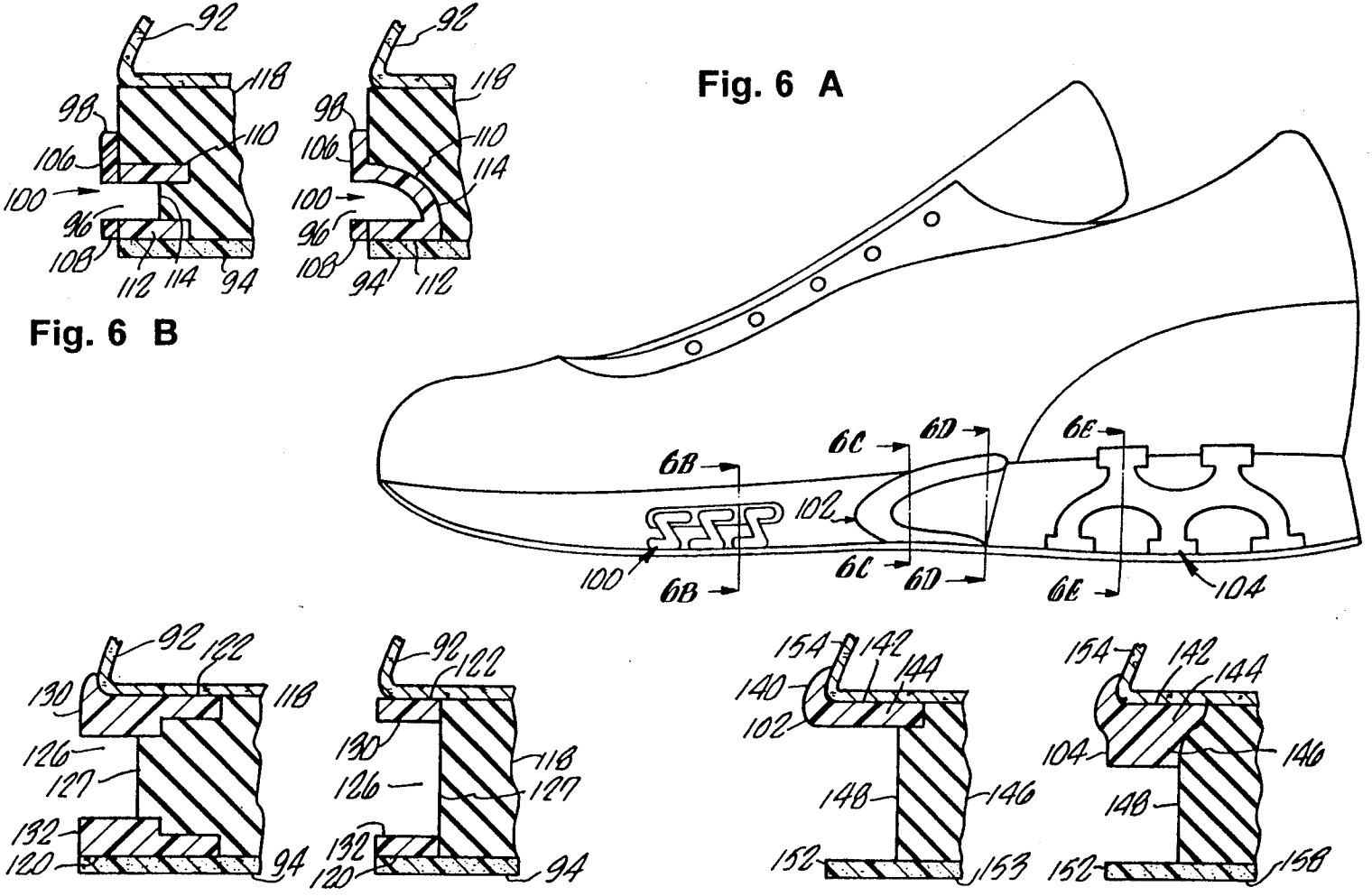
FIGS. 6B–6E are cross-sectional views taken at 1, 2, 3, and 4, respectively in FIG. 6A.

FIG. 6B shows two cross-sectional views of various embodiments of spring 100 along the line 1—1' in FIG. 6A. Upper 92, and outsole 94 are located above and below midsole 118 respectively, and a perimeter 114 of midsole 118 defines an indentation 96 adapted for fixing to spring 100. Spring 100 has a lip portion 98 extending over a surface of midsole 118 which ensures proper containment of midsole 118 to a normal shoe profile.

In FIG. 6Bi, external spring 100 is provided with prongs 106, 108, and the space between tabs 110 and 112 partially filled with midsole 118 (extending to perimeter wall 114).

In FIG. 6Bii, tabs 110, 112 are extended and connected to give a large area of surface contact with the external perimeter wall 114 of midsole 118.

FIG. 6C shows two embodiments of a section 2—2' of spring 102 with tabs 120 and 122 located above and below midsole 118 (which may have small indentations to allow acceptance of those tabs), or adjacent the upper and lower parts of an indentation 126, defined by perimeter 127 of midsole 118. Such a spring may extend as a lip over the outer wall of upper 92, as shown in FIG. 6Ci. Specifically, FIG. 6Cii is a cross-section 2—2' of spring 102, showing prongs 130, 132 abutting the side wall (or perimeter 127) of midsole 118 with the upper surface of spring 130 in contact with the lower surface of upper 92, and the upper surface of outsole 94 contacting the lower surface of spring 132.

Referring to FIGS. 6D and 6E, sections 3—3' of spring 102 and section 4—4' of spring 104, are provided as examples showing that a tab or prong of a spring need not lie vertically above or below another tab or prong to be useful as an external spring of this invention. Specifically, spring 102 has a lip 140 in contact with upper 142, and has a tab 144 extending into a portion of midsole 146 which has an indentation 148 such that the perimeters 152 and 154 of outsole 153 and upper 142 extend beyond that of midsole 146. This is clearly illustrated by perimeter 148 of midsole 146 defining a plane indicated by arrow Y, and the perimeters 154, 152 of upper 142 and outsole 153 defining a plane indicated by arrow X. It is clear that plane Y extends inwards from plane Z within the shoe, and thus represents an indentation of midsole 146.

Figure 7A:
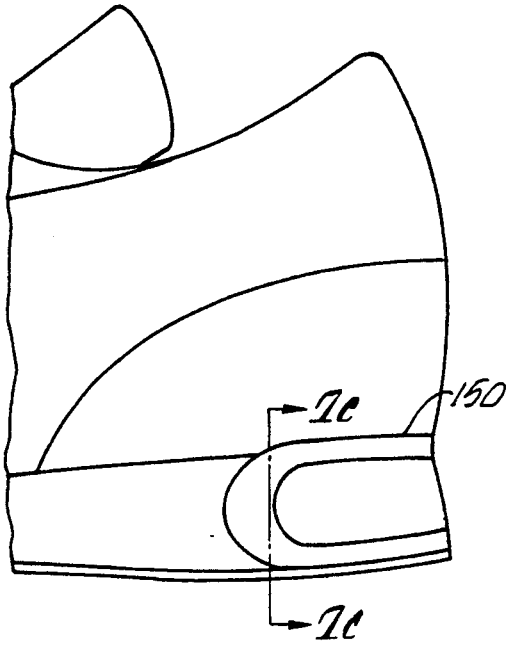
Figure 7B:
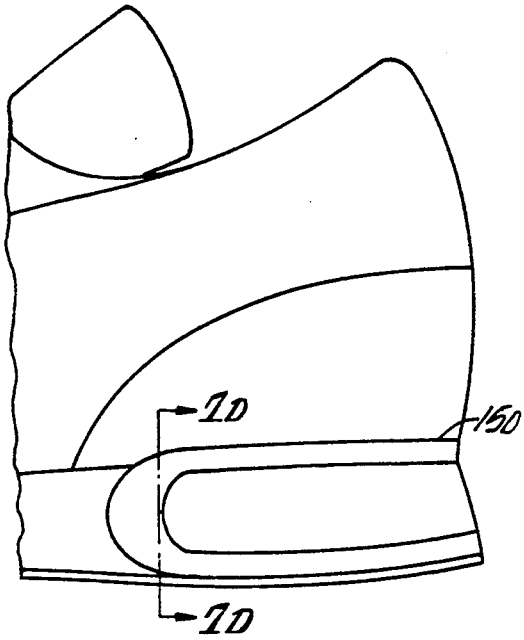

Referring to FIGS. 7A and 7B, two versions of an external spring 150 are shown. Sections of these springs are illustrated respectively in FIGS. 7C and 7D.

Figure 7C:
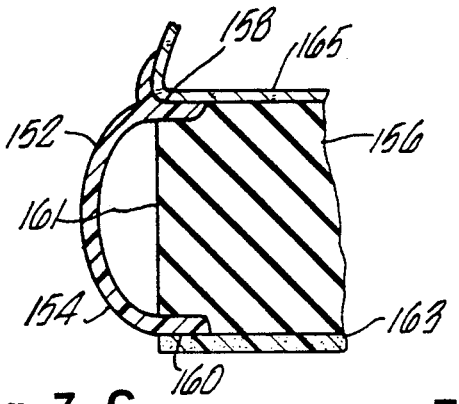
FIGS. 7C and 7D are cross-sectional views taken at 1 and 2, respectively in FIG. 7A and 7B.

Spring 150 is shown at section 1—1' in FIG. 7C. Prongs 152, 154 are angled so that bending occurs away from midsole 156 during use of the shoe. Tabs 158 and 160 connect the ends of the angled strip formed by prongs 152, 154 to midsole sidewall 161, the top of outsole 163, and the bottom of upper 165.

Figure 7D:
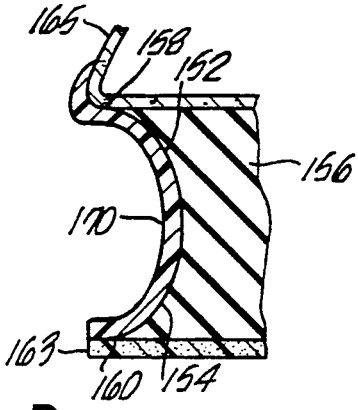
Figure 8A:
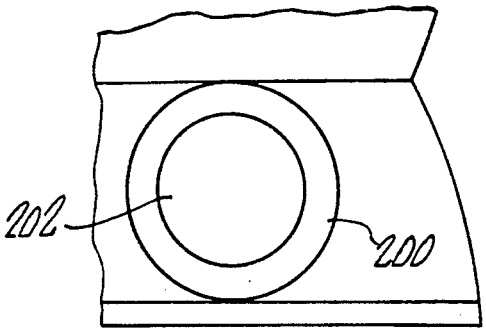
FIGS. 8A–8C show a ring-shaped spring.
Figure 8B:
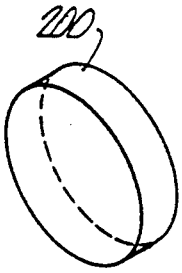
Figure 8C:
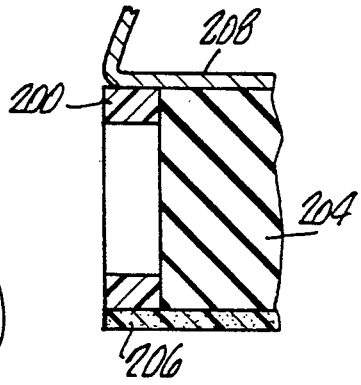

Referring to FIG. 7D, section 2—2' of spring 150 shows prongs 152, 154 oriented such that the angled strip bends toward midsole 156, when tabs 158, 160 come into closer proximity during bending. If desired some air space may be provided between spring 150 and midsole perimeter 170.

Referring to FIGS. 8A-8G, a ring-shaped spring 200 is inserted within a cylindrical indentation 202, with midsole 204 having an indentation equal to the depth of spring 200. Spring 200 is fixed adjacent upper 208 and outsole 206.

I claim:

1. An article of footwear comprising:

an upper having a first external side wall, an outsole including a first upper surface, a first lower surface and a second external side wall between the perimeters of said first upper and lower surfaces, a midsole provided between said outsole and said upper, said midsole having a second upper surface upon which a sole of a foot is positioned during use of said article of footwear, a second lower surface, and a third external side wall between the perimeters of said second upper and lower surfaces, and an external cushioning spring comprising an angled strip of resilient elastic material, one end of said strip is fixed on said second external side wall at a location at least 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force.

2. An article of footwear comprising:

an upper having a first external side wall, an outsole including a first upper surface, a first lower surface and a second external side wall between the perimeters of said first upper and lower surfaces, a midsole provided between said outsole and said upper, said midsole having a second upper surface upon which a sole of a foot is positioned during use of said article of footwear, a second lower surface, and a third external side wall between the perimeters of said second upper and lower surfaces, and an external cushioning spring comprising an angled strip of resilient elastic material, one end of said strip is fixed on said second external side wall at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force.

3. An article of footwear comprising:

an upper having a first external side wall, an outsole including a first upper surface, a first lower surface and a second external side wall between the perimeters of said first upper and lower surfaces, a midsole provided between said outsole and said upper, said midsole having a second upper surface upon which a sole of a foot is positioned during use of said article of footwear, a second lower surface, and a third external side wall between the perimeters of said second upper and lower surfaces, and an external cushioning spring comprising an angled strip of resilient elastic material, one end of said strip is fixed on said third external side wall, at a location at least 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force.

4. An article of footwear comprising:

an upper having a first external side wall, an outsole including a first upper surface, a first lower surface and a second external side wall between the perimeters of said first upper and lower surfaces, a midsole provided between said outsole and said upper, said midsole having a second upper surface upon which a sole of a foot is positioned during use of said article of footwear, a second lower surface, and a third external side wall between the perimeters of said second upper and lower surfaces, and an external cushioning spring comprising an angled strip of resilient elastic material, one end of said strip is fixed on said third external side wall, at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force.

5. The article of footwear of claim 1, 2, 3 or 4, said footwear being an athletic shoe.

6. The article of footwear of claim 1, 2, 3, or 4, wherein a portion of the perimeter of said midsole extends inward compared to a perimeter of said outsole and thereby provides an indentation in said midsole in which said spring is located.

7. The article of footwear of claim 1, 2, 3 or 4 wherein a portion of the perimeter of said midsole extends inward compared to a perimeter of said upper and thereby provides an indentation in said midsole in which said spring is located.

8. The article of footwear of claim 7 wherein said indentation is provided on at least one side of said midsole and extends less than the width and length of said midsole.

9. The article of footwear of claim 8 wherein a said indentation is provided in the rear part of said midsole.

10. The article of footwear of claim 9, wherein said spring comprises an extension adapted for insertion between said upper and said midsole.

11. The article of footwear of claim 8 wherein a said indentation is provided in the heel region of said midsole and extends less than the width of said heel.

12. The article of footwear of claim 11, wherein said angled strip is in the form of an O.

13. The article of footwear of claim 11, wherein said angled strip is in the form of an U.

14. The article of footwear of claim 11, wherein said angled strip is in the form of a V.

15. The article of footwear of claim 11, wherein said angled strip is in the form of a Y.

16. The article of footwear of claim 11, wherein said angled strip is in the form of a S.

17. The article of footwear of claim 11, wherein said angled strip is in the form of an W.

18. The article of footwear of claim 11, wherein said other end of said angled strip is generally vertically extended and in contact with said third external sidewall.

19. The article of footwear of claim 11, wherein said angled strip is in the form of a honeycomb shape.

20. The article of footwear of claim 11, wherein said angled strip is in the form of a Z.

21. The article of footwear of claim 6 wherein said indentation is provided on at least one side of said midsole and extends less than the width and length of said midsole.

22. The article of footwear of claim 21 wherein said spring is fixed below the region of the footwear designed to hold the medial aspect of a sole of a foot.

23. The article of footwear of claim 21 wherein a said indentation is provided in the near part of said midsole.

24. The article of footwear of claim 23 in which said spring is fixed to said footwear with said angled strip oriented to bend by said vertical force.

25. The article of footwear of claim 23, wherein said spring comprises an extension adapted for insertion between said outsole and said midsole.

26. The article of footwear of claim 6 wherein a said indentation is provided in the heel region of said midsole and extends less than the width of said heel.

27. The article of footwear of claim 26, wherein said angled strip is in the form of an O.

28. The article of footwear of claim 26, wherein said angled strip is in the form of an U.

29. The article of footwear of claim 26, wherein said angled strip is in the form of a V.

30. The article of footwear of claim 26, wherein said angled strip is in the form of a Y.

31. The article of footwear of claim 26, wherein said angled strip is in the form of a S.

32. The article of footwear of claim 26, wherein said angled strip is in the form of a W.

33. The article of footwear of claim 26 in which said spring is fixed to said footwear with said angled strip oriented to bend by said vertical force.

34. The article of footwear of claim 26, wherein said other end of said angled strip is generally vertically extended and in contact with said third external sidewall.

35. The article of footwear of claim 26, wherein said angled strip is in the form of a hairpin.

36. The article of footwear of claim 26, wherein said angled strip is in the form of a Z.

37. The article of footwear of claim 1, 2, 3 or 4 wherein said other end of said angled strip is generally vertically extended and in contact with said third external sidewall.

38. The article of footwear of claim 1, 2, 3, or 4, wherein both said one end and said other end are attached to said midsole.

39. The article of footwear of claim 1, 2, 3 or 4, comprising a plurality of said springs.

40. The article of footwear of claim 1, 2, 3, or 4, wherein said angled strip is applied to the surface of said midsole.

41. The article of footwear of claim 1, 2, 3, or 4, in which said spring is fixed to said footwear with said angled strip oriented to bend by said vertical force.

42. The article of footwear of claim 1, 2, 3, or 4, wherein said other end of said angled strip is generally vertically extended and in contact with said first external sidewall.

43. The article of footwear of claim 42, wherein said general vertical extension is fixed by gluing.

44. The article of footwear of claim 42, wherein said general vertical extension is fixed by stitching.

45. A method of making an article of footwear comprising the steps of:

(a) providing an upper having a first external side wall, (b) providing an outsole including a first upper surface, a first lower surface, and a second external side wall between the perimeters of said first upper and lower surfaces, (c) providing a midsole having a second upper surface upon which a sole of a foot is positioned during use, a second lower surface and a third external side wall between the perimeters of said second upper and lower surfaces, (d) providing an external cushioning spring including an angled strip of resilient elastic material, (e) fixing said midsole between said upper and said outsole, (f) fixing one end of the external cushioning spring on said second sidewall at a location at least 3 millimeters below said second upper surface of said midsole, and (g) fixing the other end of said angled strip on said first side wall at least 3 millimeters vertically above said location at which said one end is fixed, such that a vertical force on said footwear created by a wearer of said footwear striking said outsole on a solid surface causes said angled strip to bend between said one end and said other end and absorb a portion of said force.

46. A method of making an article of footwear comprising the steps of:

(a) providing an upper having a first external side wall, (b) providing an outsole including a first upper surface, a first lower surface, and a second external side wall between the perimeters of said first upper and lower surfaces, (c) providing a midsole having a second upper surface upon which a sole of a foot is positioned during use, a second lower surface and a third external side wall between the perimeters of said second upper and lower surfaces, (d) providing an external cushioning spring including an angled strip of resilient elastic material, (e) fixing said midsole between said upper and said outsole, (f) fixing one end of the external cushioning spring on said second sidewall at a location at least 3 millimeters below said second upper surface of said midsole, and (g) fixing the other end of said angled strip on said third side wall at least 3 millimeters vertically above said location at which said one end is fixed, such that a vertical force on said footwear created by a wearer of said footwear striking said outsole on a solid surface causes said angled strip to bend between said one end and said other end and absorb a portion of said force.

47. A method of making an article of footwear comprising the steps of:

(a) providing an upper having a first external side wall, (b) providing an outsole including a first upper surface, a first lower surface, and a second external side wall between the perimeters of said first upper and lower surfaces, (c) providing a midsole having a second upper surface upon which a sole of a foot is positioned during use, a second lower surface and a third external side wall between the perimeters of said second upper and lower surfaces, (d) providing an external cushioning spring including an angled strip of resilient elastic material, (e) fixing said midsole between said upper and said outsole, (f) fixing one end of the external cushioning spring on said third side wall, at a location at least 3 millimeters below said second upper surface of said midsole, and (g) fixing the other end of said angled strip on said first side wall at least 3 millimeters vertically above said location at which said one end is fixed, such that a vertical force on said footwear created by a wearer of said footwear striking said outsole on a solid surface causes said angled strip to bend between said ends one end and said other end and absorb a portion of said force.

48. A method of making an article of footwear comprising the steps of:

(a) providing an upper having a first external side wall, (b) providing an outsole including a first upper surface, a first lower surface, and a second external side wall between the perimeters of said first upper and lower surfaces, (c) providing a midsole having a second upper surface upon which a sole of a foot is positioned during use, a second lower surface and a third external side wall between the perimeters of said second upper and lower surfaces, (d) providing an external cushioning spring including an angled strip of resilient elastic material, (e) fixing said midsole between said upper and said outsole, (f) fixing one end of the external cushioning spring on said third side wall, at a location at least 3 millimeters below said second upper surface of said midsole, and (g) fixing the other end of said angled strip on said third side wall at least 3 millimeters vertically above said location at which said one end is fixed, such that a vertical force on said footwear created by a wearer of said footwear striking said outsole on a solid surface causes said angled strip to bend between said ends one end and said other end and absorb a portion of said force.

49. The method of claim 47 or 48, wherein said spring comprises an extension adapted for insertion between said outsole and said midsole, and one said fixing step comprises inserting said extension between said outsole and said midsole.

50. The method of claim 47 or 48, wherein said spring comprises an extension adapted for insertion between said midsole and said upper, and one said fixing step comprises inserting said extension between said midsole and said upper.

51. The method of claim 47 or 48, comprising providing a midsole having a portion of its perimeter extending inward compared to a perimeter of said outsole and thereby provides an indentation in said midsole in which said spring is fixed.

52. The method of claim 51 wherein said indentation is provided in the heel region of said midsole and extends less than the width of said heel.

53. The method of claim 51 wherein said spring is fixed below the region of the footwear designed to hold the medial aspect of a sole of a foot.

54. The method of claim 51 wherein said indentation is provided on at least one side of said midsole and extends less than the entire width and length of said midsole.

55. The method of claim 54 wherein said indentation is provided in the rear part of said midsole.

56. The method of claim 47 or 48 comprising providing a midsole having a portion of its perimeter extending inward compared to a perimeter of said upper and thereby provides an indentation in said midsole in which said spring is fixed.

57. The method of claim 56 wherein said spring is fixed below the region of the footwear designed to hold the medial aspect of a sole of a foot.

58. The method of claim 56 wherein said indentation is provided on at least one side of said midsole and extends less than the entire width and length of said midsole.

59. The method of claim 58 wherein said indentation is provided in the rear part of said midsole.

60. The method of claim 45 or 46, wherein said spring comprises an extension adapted for insertion between said midsole and said upper, and one said fixing step comprises inserting said extension between said midsole and said upper.

61. The method of claim 45 or 46, comprising providing a midsole having a portion of its perimeter extending inward compared to a perimeter of said upper and thereby provides an indentation in said midsole in which said spring is fixed.

62. The method of claim 61 wherein said spring is fixed below the region of the footwear designed to hold the medial aspect of a sole of a foot.

63. The method of claim 61 wherein said indention is provided on at least one side of said midsole and extends less than the entire width and length of said midsole.

64. The method of claim 63 wherein said indentation is provided in the rear part of said midsole.

65. The method of claim 45 or 46, wherein said spring comprises an extension adapted for insertion between said outsole and midsole and one said fixing step comprises inserting said extension between said outsole and said midsole.

66. The method of claim 45, 46, 47, or 48, wherein said fixing is by gluing.

67. The method of claim 45 or 46, comprising providing a midsole having a portion of its perimeter extending inward compared to a perimeter of said outsole and thereby provides an indentation in said midsole in which said spring is fixed.

68. The method of claim 67 wherein said indentation is provided on one or two sides of said midsole and extends less than the entire width and length of said midsole.

69. The method of claim 68 wherein said indentation is provided in the rear part of said midsole.

70. The method of claim 67 wherein said indentation is provided in the heel region of said midsole and extend less than the width of said heel.

71. The method of claim 67 wherein said spring is fixed below the region of the footwear designed to hold the medial aspect of a sole of a foot.

* * * * *

UNITED STATES PATENT AND TRADEMARK OFFICE

CERTIFICATE OF CORRECTION

PATENT NO. : 5,279,051
APPLICATION NO. : 07/829470
DATED : January 18, 1994
INVENTOR(S) : Ian Whatley It is certified that error appears in the above-identified patent and that said Letters Patent is hereby corrected as shown below:

Title Page

Replace the Notice language "subsequent to October 29, 2008 has been disclaimed" with the language "subsequent to February 12, 2010 has been disclaimed" to reflect the correct patent term.

Signed and Sealed this

Sixth Day of January, 2009

JON W. DUDAS
*Director of the United States Patent and Trademark Office*

US005279051C1

(12) REEXAMINATION CERTIFICATE (4837th)

United States Patent

Whatley

(10) Number: US 5,279,051 C1

(45) **Certificate Issued: *Aug. 26, 2003**

(54) FOOTWEAR CUSHIONING SPRING

(75) Inventor: Ian Whatley, 240 Donington Dr., Greenville, SC (US) 29615

(73) Assignee: Ian Whatley, Greenville, SC (US)

Reexamination Request:
No. 90/005,557, Nov. 10, 1999

Reexamination Certificate for:

| | |
|---|---|
| Patent No.: | **5,279,051** |
| Issued: | **Jan. 18, 1994** |
| Appl. No.: | **07/829,470** |
| Filed: | **Jan. 31, 1992** |

( * ) Notice: This patent is subject to a terminal disclaimer.

(51) Int. Cl.[7] ..... A43B 13/00

(52) U.S. Cl. ..... 36/25 R; 36/27; 36/71; 36/114; 36/7.8

(58) Field of Search ..... 36/27, 28, 29, 36/38, 35 R, 35 B, 71, 114, 7.8

(56) References Cited

U.S. PATENT DOCUMENTS

| | | | |
|---|---|---|---|
| 4,194,310 A | 3/1980 | Bowerman | 36/128 |
| 4,314,413 A | 2/1982 | Dassler | 35/128 |

(List continued on next page.)

FOREIGN PATENT DOCUMENTS

| | | |
|---|---|---|
| DE | 28 45 171 | 10/1978 |
| DE | 2706645 | 4/1979 |
| DE | 29 33 393 | 8/1979 |
| DE | 3329742 | 7/1984 |
| EP | 0258718 | 8/1987 |
| GB | 2 032 761 | 5/1980 |
| JP | 632224 | 8/1984 |
| JP | 635926 | 10/1984 |
| JP | 62-200904 | 12/1987 |
| JP | 3085103 | 4/1991 |
| TW | 109600 | 3/1989 |
| TW | 125849 | 12/1989 |
| TW | 128167 | 2/1990 |
| TW | 12140696 | 8/1990 |

OTHER PUBLICATIONS

Exhibit A to Nike of Japan Patent Publication 55–94201.*
Exhibit A to Nike of Japanese Utility Model 59–103605, German Patent DE 33 29 742.*
Exhibit A to Nike of Japanese Utility Model Publication 61–37303.*
Exhibit A to Nike of Taiwanese Patent No. 146576, Appl. No. 79303878.*
Exhibit A to Nike of Taiwanese Patent Document No. 77238.*
*Reebok Product Preview for Fall 1990* catalog Dated 1989 or 1990.

*Primary Examiner*—Ted Kavanaugh

(57) ABSTRACT

An article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The midsole is provided with an external cushioning spring. This spring includes one or more angled strips of resilient elastic material. One end of a strip is fixed on the surface of the midsole or outsole at a location at least 3 mm below the upper surface of the midsole. The other end of the strip is fixed on the surface of the midsole or upper at least 3 mm vertically above the location at which the other end is fixed. The external cushioning spring is fixed in a manner such that a vertical force on the footwear created by a wearer of the footwear striking the outsole on a solid surface causes the angled strip to bend between or at its ends, thereby absorbing a portion of the force.

(Amended)

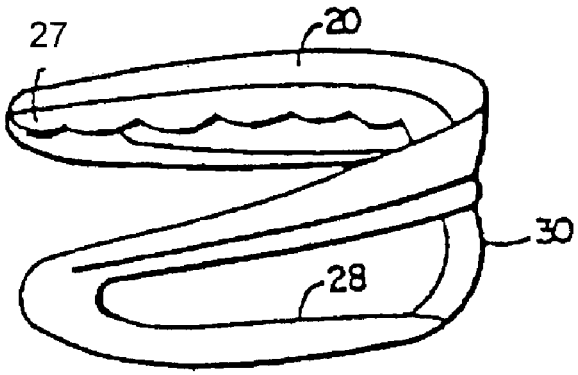

U.S. PATENT DOCUMENTS

| | | | | |
|---|---|---|---|---|
| 4,316,334 | A | | 2/1982 | Hunt ..... 36/91 |
| 4,399,621 | A | | 8/1983 | Dassler ..... 36/32 R |
| 4,459,765 | A | | 7/1984 | Power ..... 36/88 |
| 4,484,397 | A | | 11/1984 | Curley, Jr. ..... 36/92 |
| 4,598,487 | A | | 7/1986 | Misevich ..... 36/114 |
| 4,638,577 | A | | 1/1987 | Riggs ..... 36/114 |
| 4,641,438 | A | | 2/1987 | Laird et al. ..... 36/59 |
| 4,697,362 | A | | 10/1987 | Wasserman ..... 36/136 |
| 4,712,319 | A | | 12/1987 | Goria ..... 36/137 |
| 4,798,010 | A | | 1/1989 | Sugiyama ..... 36/30 R |
| 4,854,055 | A | | 8/1989 | Sugiyama et al. ..... 37/128 |
| 4,866,861 | A | | 9/1989 | Noone ..... 36/127 |
| 4,947,560 | A | | 8/1990 | Fuerst et al. ..... 36/88 |
| 4,949,476 | A | | 8/1990 | Anderie ..... 36/129 |
| 5,005,300 | A | * | 4/1991 | Diaz et al. |
| 5,014,449 | A | | 5/1991 | Richard et al. ..... 36/114 |
| 5,046,267 | A | | 9/1991 | Kilgore et al. ..... 36/114 |
| 5,052,130 | A | | 10/1991 | Barry et al. ..... 36/107 |
| 5,224,277 | A | | 7/1993 | Sang Do ..... 36/27 |
| 5,247,742 | A | | 9/1993 | Kilgore et al. ..... 36/114 |
| 5,297,349 | A | | 3/1994 | Kilgore ..... 36/114 |
| 5,353,526 | A | | 10/1994 | Foley et al. ..... 36/92 |

* cited by examiner

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Figure 1D:
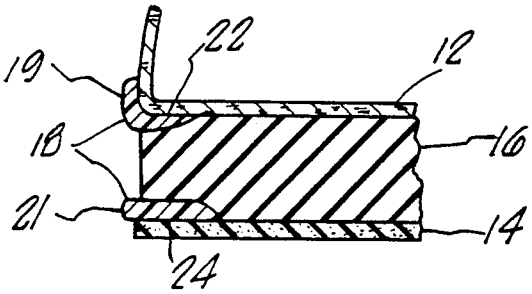
Figure 1E:
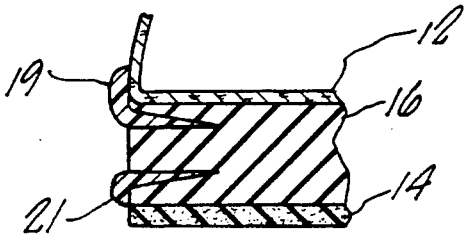

Column 5, lines 12–18:

FIG. 1A is an isometric side view of an athletic shoe having springs in the heel and ball regions of the foot; FIG. 1B is an isometric view of the spring shown in the ball region; FIG. 1C is an isometric view of the spring shown in the heel region; FIGS. 1D and E are cross-sectional views taken at [Y] *1D* and [X] *1E* in FIG. 1A, respectively;

Column 5, lines 24–25:

FIGS. 6B–6E are cross-sectional views taken at [1, 2, 3, and 4] *6B, 6C, 6D, and 6E*, respectively in FIG. 6A;

Column 5, lines 26–27:

FIGS. 7C and 7D are cross-sectional views taken at [1 and 2] *7C and 7D*, respectively in FIG. 7A and 7B; and Column 5, lines 51–61:

Referring to 1C, heel spring 20 is provided with a tab [26] *27*, again formed generally perpendicular to the inner surface of heel spring 20 and adapted for insertion between upper 12 and midsole 16 in the heel region. Lower portion 28 of heel spring 20 is connected to shoe 10 by a generally flat tab 30 which is positioned and held with midsole 16 or between midsole 16 and outsole 14. Alternatively, tab 30 may be connected to the outer surface of shoe 10 by adhesive. Tab 30 is connected at a location at least 3 millimeters below plane 26, i.e., where the heel of the wearer contacts the midsole.

Column 6, lines 41–55:

Referring to FIGS. 3A–3F there are shown seven other embodiments of springs suitable for use in this invention. In FIG. 3A, there is shown a spring 50 in the heel region shaped in the form of a safety pin, and connected between the midsole and upper and on the surface of the midsole by a tab (not shown) formed perpendicularly to the inner surface of spring 50. In the ball region is shown a spring 52 fixed by one or more perpendicular tabs (not shown) between the midsole and upper, midsole and midsole, or between the midsole and outsole, having a generally boomerang-shaped spring attached thereto. Referring to FIGS. 3B, 3C, 3D, 3E, and 3F, there are shown various heel springs [(e.g., 54, 56)] formed as V-, U-, Z-, J-, S- and other shapes, respectively.

Column 7, lines 8–15:

FIG. 6B shows two cross-sectional views of various embodiments of spring 100 along the line [1—1'] *6B—6B* in FIG. 6A. Upper 92, and outsole 94 are located above and below midsole 118 respectively, and a perimeter 114 of midsole 118 defines an indentation 96 adapted for fixing to spring 100. Spring 100 has a lip portion 98 extending over a surface of midsole 118 which ensures proper containment of midsole 118 to a normal shoe profile.

Column 7, lines 16–19:

In FIG. 6B[i], external spring 100 is provided with prongs 106, 108, and the space between tabs 110 and 112 partially filled with midsole 118 (extending to perimeter wall 114).

Column 7, lines 20–22:

In FIG. 6B[ii], tabs 110, 112 are extended and connected to give a large area of surface contact with the external perimeter wall 114 of midsole 118.

Column 7, lines 23–35:

FIG. 6C shows two embodiments of a section [2—2'] *6C—6C* of spring 102 with tabs 120 and 122 located above and below midsole 118 (which may have small indentations to allow acceptance of those tabs), or adjacent the upper and lower parts of an indentation 126, defined by perimeter 127 of midsole 118. Such a spring may extend as a lip over the outer wall of upper 92, as shown in FIG. 6C[i]. Specifically, FIG. 6C[ii] is a cross-section [2—2'] *6C—6C* of spring 102, showing prongs 130, 132 abutting the side wall (or perimeter 127) of midsole 118 with the upper surface of spring 130 in contact with the lower surface of upper 92, and the upper surface of outsole 94 contacting the lower surface of spring 132.

Column 7, lines 36–51:

Referring to FIGS. 6D and 6E, sections [3—3'] *6D—6D* of spring 102 and section [4—4'] *6E—6E* of spring 104, are provided as examples showing that a tab or prong of a spring need not lie vertically above or below another tab or prong to be useful as an external spring of this invention. Specifically, spring 102 has a lip 140 in contact with upper 142, and has a tab 144 extending into a portion of midsole 146 which has an indentation 148 such that the perimeters 152 and 154 of outsole 153 and upper 142 extend beyond that of midsole 146. This is clearly illustrated by perimeter 148 of midsole 146 defining a plane [indicated by arrow Y], and the perimeters 154, 152 of upper 142 and outsole 153 defining a plane [indicated by arrow X]. It is clear that [plane Y] *this plane of the midsole 146* extends inwards from [plane Z] *this plane of the upper 142 and outsole 153* within the shoe, and thus represents an indentation of midsole 146.

Column 7, lines 55–60:

Spring 150 is shown at section [1—1'] *7C—7C* in FIG. 7C. Prongs 152, 154 are angled so that bending occurs away from midsole 156 during use of the shoe. Tabs 158 and 160 connect the ends of the angled strip formed by prongs 152, 154 to midsole sidewall 161, the top of outsole 163, and the bottom of upper 165.

Column 7, lines 61–66:

Referring to FIG. 7D, section [2—2'] *7D—7D* of spring 150 shows prongs 152, 154 oriented such that the angled strip bends toward midsole 156, when tabs 158, 160 come into closer proximity during bending. If desired some air space may be provided between spring 150 and midsole perimeter 170.

THE DRAWING FIGURES HAVE BEEN CHANGED AS FOLLOWS:

FIG. No. 1C: reference numeral 26 has been changed to 27.

AS A RESULT OF REEXAMINATION, IT HAS BEEN DETERMINED THAT:

The patentability of claims 1, 4, 46 and 47 is confirmed.

Claims 2, 3, 38–41, 45 and 48 are cancelled.

Claims 5–7, 23, 37, 42, 49–51, 56, 60–61, and 65–67 are determined to be patentable as amended.

Claims 8–22, 24–36, 43, 44, 52–55, 57–59, 62–64, and 68–71, dependent on an amended claim, are determined to be patentable.

New claims 72–92 are added and determined to be patentable.

5. The article of footwear of claim 1[, 2, 3] or 4, said footwear being an athletic shoe.

6. The article of footwear of claim 1[, 2, 3,] or 4, wherein a portion of the perimeter of said midsole extends inward compared to a perimeter of said outsole and thereby provides an indentation in said midsole in which said spring is located.

7. The article of footwear of claim 1[, 2, 3] or 4 wherein a portion of the perimeter of said midsole extends inward compared to a perimeter of said upper and thereby provides an indentation in said midsole in which said spring is located.

23. The article of footwear of claim 21 wherein a said indentation is provided in the [near] *rear* part of said midsole.

37. The article of footwear of claim 1[, 2, 3] or 4 wherein said other end of said angled strip is generally vertically extended and in contact with said third external sidewall.

42. The article of footwear of claim 1[, 2, 3] or 4, wherein said other end of said angled strip is generally vertically extended and in contact with said first external sidewall.

49. The method of claim 47 [or 48], wherein said spring comprises an extension adapted for insertion between said outsole and said midsole, and one said fixing step comprises inserting said extension between said outsole and said midsole.

50. The method of claim 47 [or 48], wherein said spring comprises an extension adapted for insertion between said midsole and said upper, and one said fixing step comprises inserting said extension between said midsole and said upper.

51. The method of claim 47 [or 48], comprising providing a midsole having a portion of its perimeter extending inward compared to a perimeter of said outsole and thereby provides an indentation in said midsole in which said spring is fixed.

56. The method of claim 47 [or 48] comprising providing a midsole having a portion of its perimeter extending inward compared to a perimeter of said upper and thereby provides an indentation in said midsole in which said spring is fixed.

60. The method of claim [45 or] 46, wherein said spring comprises an extension adapted for insertion between said midsole and said upper, and one said fixing step comprises inserting said extension between said midsole and said upper.

61. The method of claim [45 or] 46, comprising providing a midsole having a portion of its perimeter extending inward compared to a perimeter of said upper and thereby provides an indentation in said midsole in which said spring is fixed.

65. The method of claim [45 or] 46, wherein said spring comprises an extension adapted for insertion between said outsole and midsole and one said fixing step comprises inserting said extension between said outsole and said midsole.

66. The method of claim [45, 46, 47, or 48] *46 or 47*, wherein said fixing is by gluing.

67. The method of claim [45 or] 46, comprising providing a midsole having a portion of its perimeter extending inward compared to a perimeter of said outsole and thereby provides an indentation in said midsole in which said spring is fixed.

*72. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said second external side wall at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force, wherein a portion of the perimeter of said midsole extends inward compared to a perimeter of said outsole and thereby provides an indentation in said midsole in which said spring is located.*

*73. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said second external side wall at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force, wherein a portion of the perimeter of said midsole extends inward compared to a perimeter of said upper and thereby provides an indentation in said midsole in which said spring is located.*

*74. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said second external side wall at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force, wherein a portion of the perimeter of said midsole extends inward compared to a perimeter of said upper and thereby provides an indentation in said midsole in which said spring is located, wherein said indentation is provided on at least one side of said midsole and extends less than the width and length of said midsole, wherein a said indentation is provided in the rear part of said midsole, and wherein said spring comprises an extension adapted for insertion between said upper and said midsole.*

*75. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said third external side wall, at a location at leat 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force, wherein a portion of the perimeter of said midsole extends inward compared to a perimeter of said upper and thereby provides an indentation in said midsole in which said spring is located, wherein said indentation is provided on at least one side of said midsole and extends less than the width and length of said midsole, wherein a said indentation is provided in the rear part of said midsole, and wherein said spring comprises an extension adapted for insertion between said upper and said midsole.*

*76. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said second external side wall at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force, wherein a portion of the perimeter of said midsole extends inward compared to a perimeter of said outsole and thereby provides an indentation in said midsole in which said spring is located, wherein said indentation is provided on at least one side of said midsole and extends less than the width and length of said midsole, wherein a said indentation is provided in the rear part of said midsole, and wherein said spring comprises an extension adapted for insertion between said outsole and said midsole.*

*77. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said third external side wall, at a location at least 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force, wherein a portion of the perimeter of said midsole extends inward compared to a perimeter of said outsole and thereby provides an indentation in said midsole in which said spring is located, wherein said indentation is provided on at least one side of said midsole and extends less than the width and length of said midsole, wherein a said indentation is provided in the rear part of said midsole, and wherein said spring comprises an extension adapted for insertion between said outsole and said midsole.*

*78. A method of making an article of footwear comprising the steps of:*

*(a) providing an upper having a first external side wall,*

*(b) providing an outsole including a first upper surface, a first lower surface, and a second external side wall between the perimeters of said first upper and lower surfaces,*

*(c) providing a midsole having a second upper surface upon which a sole of a foot is positioned during use, a second lower surface and a third external side wall between the perimeters of said second upper and lower surfaces,*

*(d) providing an external cushioning spring including an angled strip of resilient elastic material,*

*(e) fixing said midsole between said upper and said outsole,*

(f) *fixing one end of the external cushioning spring on said third side wall, at a location at least 3 millimeters below said second upper surface of said midsole, and*

(g) *fixing the other end of said angled strip on said third side wall at least 3 millimeters vertically above said location at which said one end is fixed, such that a vertical force on said footwear created by a wearer of said footwear striking said outsole on a solid surface causes said angled strip to bend between said ends one end and said other end and absorb a portion of said force, wherein said spring comprises an extension adapted for insertion between said outsole and said midsole, and one said fixing step comprises inserting said extension between said outsole and said midsole.*

*79. A method of making an article of footwear comprising the steps of:*

(a) *providing an upper having a first external side wall,*

(b) *providing an outsole including a first upper surface, a first lower surface, and a second external side wall between the perimeters of said first upper and lower surfaces,*

(c) *providing a midsole having a second upper surface upon which a sole of a foot is positioned during use, a second lower surface and a third external side wall between the perimeters of said second upper and lower surfaces,*

(d) *providing an external cushioning spring including an angled strip of resilient elastic material,*

(e) *fixing said midsole between said upper and said outsole,*

(f) *fixing one end of the external cushioning spring on said third side wall, at a location at least 3 millimeters below said second upper surface of said midsole, and*

(g) *fixing the other end of said angled strip on said third side wall at least 3 millimeters vertically above said location at which said one end is fixed, such that a vertical force on said footwear created by a wearer of said footwear striking said outsole on a solid surface causes said angled strip to bend between said ends one end and said other end and absorb a portion of said force, wherein said spring comprises an extension adapted for insertion between said midsole and said upper, and one said fixing step comprises inserting said extension between said midsole and said upper.*

*80. A method of making an article of footwear comprising the steps of:*

(a) *providing an upper having a first external side wall,*

(b) *providing an outsole including a first upper surface, a first lower surface, and a second external side wall between the perimeters of said first upper and lower surfaces,*

(c) *providing a midsole having a second upper surface upon which a sole of a foot is positioned during use, a second lower surface and a third external side wall between the perimeters of said second upper and lower surfaces,*

(d) *providing an external cushioning spring including an angled strip of resilient elastic material,*

(e) *fixing said midsole between said upper and said outsole,*

(f) *fixing one end of the external cushioning spring on said second sidewall at a location at least 3 millimeters below said second upper surface of said midsole, and*

(g) *fixing the other end of said angled strip on said first side wall at least 3 millimeters vertically above said location at which said one end is fixed, such that a vertical force on said footwear created by a wearer of said footwear striking said outsole on a solid surface causes said angled strip to bend between said one end and said other end and absorb a portion of said force, wherein said spring comprises an extension adapted for insertion between said midsole and said upper, and one said fixing step comprises inserting said extension between said midsole and said upper.*

*81. A method of making an article of footwear comprising the steps of:*

(a) *providing an upper having a first external side wall,*

(b) *providing an outsole including a first upper surface, a first lower surface, and a second external side wall between the perimeters of said first upper and lower surfaces,*

(c) *providing a midsole having a second upper surface upon which a sole of a foot is positioned during use, a second lower surface and a third external side wall between the perimeters of said second upper and lower surfaces,*

(d) *providing an external cushioning spring including an angled strip of resilient elastic material,*

(e) *fixing said midsole between said upper and said outsole,*

(f) *fixing one end of the external cushioning spring on said second sidewall at a location at least 3 millimeters below said second upper surface of said midsole, and*

(g) *fixing the other end of said angled strip on said first side wall at least 3 millimeters vertically above said location at which said one end is fixed, such that a vertical force on said footwear created by a wearer of said footwear striking said outsole on a solid surface causes said angled strip to bend between said one end and said other end and absorb a portion of said force,*

(h) *providing a midsole having a portion of its perimeter extending inward compared to a perimeter of said upper and thereby provides an indentation in said midsole in which said spring is fixed.*

*82. A method of making an article of footwear comprising the steps of:*

(a) *providing an upper having a first external side wall,*

(b) *providing an outsole including a first upper surface, a first lower surface, and a second external side wall between the perimeters of said first upper and lower surfaces,*

(c) *providing a midsole having a second upper surface upon which a sole of a foot is positioned during use, a second lower surface and a third external side wall between the perimeters of said second upper and lower surfaces,*

(d) *providing an external cushioning spring including an angled strip of resilient elastic material,*

(e) *fixing said midsole between said upper and said outsole,*

(f) *fixing one end of the external cushioning spring on said second sidewall at a location at least 3 millimeters below said second upper surface of said midsole, and*

(g) *fixing the other end of said angled strip on said first side wall at least 3 millimeters vertically above said location at which said one end is fixed, such that a vertical force on said footwear created by a wearer of said footwear striking said outsole on a solid surface causes said angled strip to bend between said one end*

*and said other end and absorb a portion of said force, wherein said spring comprises an extension adapted for insertion between said outsole and midsole and one said fixing step comprises inserting said extension between said outsole and said midsole.*

*83. A method of making an article of footwear comprising the steps of:*

*(a) providing an upper having a first external side wall,*

*(b) providing an outsole including a first upper surface, a first lower surface, and a second external side wall between the perimeters of said first upper and lower surfaces,*

*(c) providing a midsole having a second upper surface upon which a sole of a foot is positioned during use, a second lower surface and a third external side wall between the perimeters of said second upper and lower surfaces,*

*(d) providing an external cushioning spring including an angled strip of resilient elastic material,*

*(e) fixing said midsole between said upper and said outsole,*

*(f) fixing one end of the external cushioning spring on said second sidewall at a location at least 3 millimeters below said second upper surface of said midsole, and*

*(g) fixing the other end of said angled strip on said first side wall at least 3 millimeters vertically above said location at which said one end is fixed, such that a vertical force on said footwear created by a wearer of said footwear striking said outsole on a solid surface causes said angled strip to bend between said one end and said other end and absorb a portion of said force,*

*(h) providing a midsole having a portion of its perimeter extending inward compared to a perimeter of said outsole and thereby provides an indentation in said midsole in which said spring is fixed.*

*84. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said third external side wall, at a location at least 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force, wherein said other end of said angled strip is generally vertically extended and in contact with said first external sidewall.*

*85. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said second external side wall at a location at least 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force, wherein said spring comprises an extension adapted for insertion between said outsole and said midsole.*

*86. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said second external side wall at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force, wherein said spring comprises an extension adapted for insertion between said outsole and said midsole.*

*87. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said third external side wall, at a location at least 3 mm below said second upper surface of said midsole, and the other end of said strip is fixed on said third external side wall, at least 3 mm vertically above said location, such that a vertical force on said footwear created by a wearer of said footwear striking said outsole on a solid surface causes said angled strip to bend between said one end and said other end and absorb a portion of said force, wherein said spring comprises an extension adapted for insertion between said outsole and said midsole.*

*88. An article of footwear comprising:*

*an upper having a first external side wall,*

*an outsole including a first upper surface, a first lower surface and a second external side wall between the perimeters of said first upper and lower surfaces,*

*a midsole provided between said outsole and said upper, said midsole having a second upper surface upon which a sole of a foot is positioned during use of said article of footwear, a second lower surface, and a third external side wall between the perimeters of said second upper and lower surfaces, and*

*an external cushioning spring comprising an angled strip of resilient elastic material, one end of said strip is fixed on said third external side wall, at a location at least 3 mm below said second upper surface of said midsole, and the other end of said strip is fixed on said first external side wall, at least 3 mm vertically above said location, such that a vertical force on said footwear created by a wearer of said footwear striking said outsole on a solid surface causes said angled strip to bend between said one end and said other end and absorb a portion of said force, wherein said spring comprises an extension adapted for insertion between said outsole and said midsole.*

*89. A method of making an article of footwear comprising the steps of:*

(*a*) *providing an upper having a first external side wall,*

(*b*) *providing an outsole including a first upper surface, a first lower surface, and a second external side wall between the perimeters of said first upper and lower surfaces,*

(*c*) *providing a midsole having a second upper surface upon which a sole of a foot is positioned during use, a second lower surface and a third external side wall between the perimeters of said second upper and lower surfaces,*

(*d*) *providing an external cushioning spring including an angled strip of resilient elastic material,*

(*e*) *fixing said midsole between said upper and said outsole,*

(*f*) *fixing one end of the external cushioning spring on said third side wall, at a location at least 3 millimeters below said second upper surface of said midsole,*

(*g*) *fixing the other end of said angled strip on said third side wall at least 3 millimeters vertically above said location at which said one end is fixed, such that a vertical force on said footwear created by a wearer of said footwear striking said outsole on a solid surface causes said angled strip to bend between said ends one end and said other end and absorb a portion of said force, wherein said spring comprises an extension adapted for insertion between said outsole and said midsole, and one said fixing step comprises inserting said extension between said outsole and said midsole,*

(*h*) *providing a midsole having a portion of its perimeter extending inward compared to a perimeter of said outsole and thereby provides an indentation in said midsole in which said spring is fixed.*

*90. The article of footwear of claim 1 or 4, comprising a plurality of said springs.*

*91. The article of footwear of claim 1 or 4, in which said spring is fixed to said footwear with said angled strip oriented to bend by said vertical force.*

*92. The article of footwear of claim 73 wherein said indentation is provided on at least one side of said midsole and extends less than the width and length of said midsole.*

* * * * *

US005279051C2

(12) EX PARTE REEXAMINATION CERTIFICATE (7746th)

United States Patent

Whatley

(10) Number: US 5,279,051 C2

(45) Certificate Issued: Sep. 14, 2010

(54) FOOTWEAR CUSHIONING SPRING

(75) Inventor: Ian Whatley, Greenville, SC (US)

(73) Assignee: Cushion Technologies, LLC, Richardson, TX (US)

Reexamination Request:
No. 90/008,875, Oct. 10, 2007

Reexamination Certificate for:

| | |
|---|---|
| Patent No.: | **5,279,051** |
| Issued: | **Jan. 18, 1994** |
| Appl. No.: | **07/829,470** |
| Filed: | **Jan. 31, 1992** |

Reexamination Certificate C1 5,279,051 issued Aug. 26, 2003

Certificate of Correction issued Jan. 6, 2009.

(51) Int. Cl.
*A43B 13/00* (2006.01)

(52) U.S. Cl. ..... 36/25 R; 36/27; 36/71; 36/114; 36/7.8

(58) Field of Classification Search ..... None
See application file for complete search history.

(56) References Cited

U.S. PATENT DOCUMENTS

| | | | |
|---|---|---|---|
| 87,722 | A | 3/1869 | Stewart |
| 224,937 | A | 2/1880 | Mintzer |
| 226,792 | A | 4/1880 | Robinson |
| 323,971 | A | 8/1885 | Swan |
| 354,986 | A | 12/1886 | Martin |
| 532,429 | A | 1/1895 | Rogers |
| 729,761 | A | 6/1903 | Harland |
| 861,947 | A | 7/1907 | Brennan |
| 898,951 | A | 9/1908 | Zooboavch |
| 959,956 | A | 5/1910 | Moorefield |
| 1,188,717 | A | 6/1916 | Bennett |
| 1,347,061 | A | 7/1920 | Steinbrecher |
| 1,470,592 | A | 10/1923 | Berthet |
| 1,767,801 | A | 6/1930 | Laible |
| 1,830,091 | A | 11/1931 | Cox |

(Continued)

FOREIGN PATENT DOCUMENTS

| | | | |
|---|---|---|---|
| DE | 1670403 | | 1/1954 |
| DE | 2424889 | | 12/1975 |
| DE | 7729025 | | 1/1978 |
| DE | 2654116 | A1 | 6/1978 |
| DE | 2706645 | A1 | 8/1978 |
| DE | 2933393 | A1 | 2/1981 |
| DE | 3034126 | A1 | 3/1982 |
| DE | 3317462 | A1 | 10/1983 |
| DE | 3320502 | A1 | 12/1983 |
| DE | 3430845 | A1 | 7/1985 |

(Continued)

OTHER PUBLICATIONS

Runners World Magazine, Sep. 1990.
Runners World Magazine, Oct. 1985.
Runners World Magazine, Apr. 1988.

*Primary Examiner*—Matthew C. Graham

(57) ABSTRACT

An article of footwear, for example, an athletic shoe designed for walking, running, or other sports activities. The article of footwear is provided with an upper, an outsole, and a midsole positioned between the outsole and the upper. The midsole has an upper surface upon which a sole of a foot is positioned during use of the article. The midsole is provided with an external cushioning spring. This spring includes one or more angled strips of resilient elastic material. One end of a strip is fixed on the surface of the midsole or outsole at a location at least 3 mm below the upper surface of the midsole. The other end of the strip is fixed on the surface of the midsole or upper at least 3 mm vertically above the location at which the other end is fixed. The external cushioning spring is fixed in a manner such that a vertical force on the footwear created by a wearer of the footwear striking the outsole on a solid surface causes the angled strip to bend between or at its ends, thereby absorbing a portion of the force.

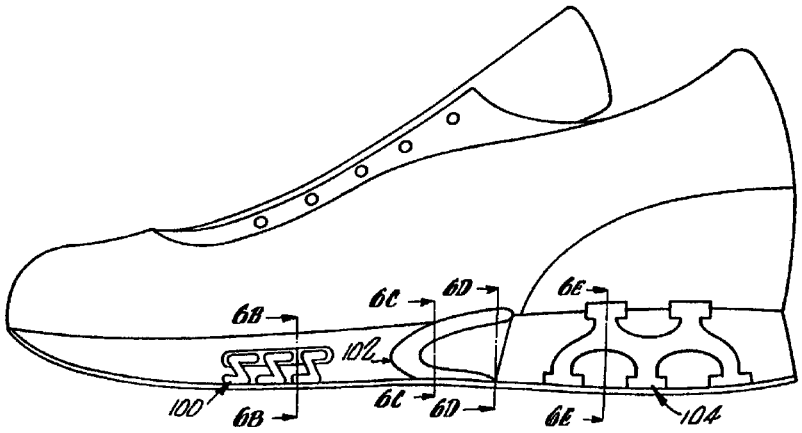

U.S. PATENT DOCUMENTS

| | | | |
|---|---|---|---|
| 2,123,288 | A | 7/1938 | Noyes |
| 2,275,720 | A | 3/1942 | Bingham, Jr. |
| 2,399,543 | A | 4/1946 | Dack |
| 2,444,865 | A | 7/1948 | Warrington |
| 2,508,318 | A | 5/1950 | Wallach |
| 2,555,654 | A | 6/1951 | Ostrom |
| 2,804,700 | A | 9/1957 | Holtkamp et al. |
| 2,953,861 | A | 9/1960 | Horten |
| 3,028,689 | A | 4/1962 | Dassler |
| 3,029,530 | A | 4/1962 | Eaton |
| 3,777,374 | A | 12/1973 | Hendricks |
| 3,822,488 | A | 7/1974 | Johnson |
| 3,834,046 | A | 9/1974 | Fowler |
| 3,886,674 | A | 6/1975 | Pavia |
| 4,030,213 | A | 6/1977 | Daswick |
| 4,102,061 | A | 7/1978 | Saaristo |
| 4,128,950 | A | 12/1978 | Bowerman et al. |
| 4,194,310 | A | 3/1980 | Bowerman |
| D256,067 | S | 7/1980 | Hagg et al. |
| 4,235,026 | A | 11/1980 | Plagenhoef |
| 4,255,877 | A | 3/1981 | Bowerman |
| 4,297,796 | A | 11/1981 | Stirtz et al. |
| 4,314,413 | A | 2/1982 | Dassler |
| 4,316,334 | A | 2/1982 | Hunt |
| 4,342,158 | A | 8/1982 | McMahon et al. |
| 4,372,058 | A | 2/1983 | Stubblefield |
| 4,399,621 | A | 8/1983 | Dassler |
| 4,402,146 | A | 9/1983 | Parracho et al. |
| 4,435,910 | A | 3/1984 | Marc |
| 4,449,306 | A | 5/1984 | Cavanagh |
| 4,449,307 | A | 5/1984 | Stubblefield |
| 4,451,994 | A | 6/1984 | Fowler |
| 4,459,765 | A | 7/1984 | Power |
| 4,484,397 | A | 11/1984 | Curley, Jr. |
| 4,492,046 | A | 1/1985 | Kosova |
| 4,506,460 | A | 3/1985 | Rudy |
| 4,536,974 | A | 8/1985 | Cohen |
| 4,542,598 | A | 9/1985 | Misevich et al. |
| 4,546,555 | A | 10/1985 | Spademan |
| 4,546,559 | A | 10/1985 | Dassler |
| 4,561,195 | A | 12/1985 | Onoda et al. |
| 4,566,206 | A | 1/1986 | Weber |
| 4,573,279 | A | 3/1986 | Feurer-Zogel et al. |
| 4,592,153 | A | 6/1986 | Jacinto |
| 4,598,487 | A | 7/1986 | Misevich |
| 4,611,412 | A | 9/1986 | Cohen |
| 4,614,046 | A | 9/1986 | Dassler |
| 4,625,435 | A | 12/1986 | Ueda |
| 4,638,577 | A | 1/1987 | Riggs |
| 4,641,438 | A | 2/1987 | Laird et al. |
| 4,676,011 | A | 6/1987 | O'Rourke et al. |
| D291,146 | S | 8/1987 | Selbiger |
| 4,697,362 | A | 10/1987 | Wasserman |
| 4,712,319 | A | 12/1987 | Goria |
| 4,731,939 | A | 3/1988 | Parracho et al. |
| D296,150 | S | 6/1988 | Diaz |
| 4,753,021 | A | 6/1988 | Cohen |
| 4,754,559 | A | 7/1988 | Cohen |
| 4,757,620 | A | 7/1988 | Tiitola |
| D296,952 | S | 8/1988 | Brown et al. |
| 4,766,679 | A | 8/1988 | Bender |
| 4,771,554 | A | 9/1988 | Hannemann |
| 4,776,111 | A | 10/1988 | Crowley |
| 4,790,083 | A | 12/1988 | Dufour |
| 4,798,010 | A | 1/1989 | Sugiyama |
| D299,785 | S | 2/1989 | Diaz |
| 4,854,055 | A | 8/1989 | Sugiyama et al. |
| 4,866,861 | A | 9/1989 | Noone |
| 4,876,806 | A | 10/1989 | Robinson et al. |
| 4,878,301 | A | 11/1989 | Kiyosawa |
| 4,881,329 | A | 11/1989 | Crowley |
| 4,910,884 | A | 3/1990 | Lindh et al. |
| 4,922,631 | A | 5/1990 | Anderie |
| 4,924,605 | A | 5/1990 | Spademan |
| 4,942,677 | A | 7/1990 | Flemming et al. |
| 4,944,099 | A | 7/1990 | Davis |
| 4,947,560 | A | 8/1990 | Fuerst et al. |
| 4,949,476 | A | 8/1990 | Anderie |
| 4,972,611 | A | 11/1990 | Swartz et al. |
| 4,989,350 | A | 2/1991 | Bunch et al. |
| D315,633 | S | 3/1991 | Nakao |
| 5,005,299 | A | 4/1991 | Whatley |
| 5,005,300 | A | 4/1991 | Diaz et al. |
| 5,014,449 | A | 5/1991 | Richard et al. |
| D319,718 | S | 9/1991 | Del Vecchio, Jr. et al. |
| 5,046,264 | A | 9/1991 | Hultzsch et al. |
| 5,046,267 | A | 9/1991 | Kilgore et al. |
| 5,052,130 | A | 10/1991 | Barry et al. |
| 5,060,401 | A | 10/1991 | Whatley |
| 5,070,629 | A | 12/1991 | Graham et al. |
| 5,090,138 | A | 2/1992 | Borden |
| D325,288 | S | 4/1992 | Richard et al. |
| 5,131,173 | A | 7/1992 | Anderie |
| 5,138,776 | A | 8/1992 | Levin |
| 5,155,297 | A | 10/1992 | Lindstadt et al. |
| 5,185,943 | A | 2/1993 | Tong et al. |
| 5,187,883 | A | 2/1993 | Penney |
| 5,224,277 | A | 7/1993 | Sang Do |
| 5,247,742 | A | 9/1993 | Kilgore et al. |
| 5,255,451 | A | 10/1993 | Tong et al. |
| 5,297,349 | A | 3/1994 | Kilgore |
| 5,311,678 | A | 5/1994 | Spademan |
| 5,319,866 | A | 6/1994 | Foley et al. |
| 5,319,869 | A | 6/1994 | McDonald et al. |
| 5,337,492 | A | 8/1994 | Anderie et al. |
| 5,343,639 | A | 9/1994 | Kilgore et al. |
| 5,353,526 | A | 10/1994 | Foley et al. |
| 5,595,003 | A | 1/1997 | Snow |
| 5,896,608 | A | 4/1999 | Whatley |

FOREIGN PATENT DOCUMENTS

| | | | |
|---|---|---|---|
| DE | 8504763 | | 7/1985 |
| DE | 8508599 | | 8/1985 |
| DE | 3415705 | A1 | 10/1985 |
| DE | 3542960 | A1 | 6/1986 |
| DE | 8626233 | | 1/1987 |
| DE | 3538601 | A1 | 5/1987 |
| DE | 8225659 | | 6/1987 |
| DE | 3629340 | A1 | 3/1988 |
| DE | 8905050 | | 9/1989 |
| EP | 0096542 | | 12/1983 |
| EP | 0103041 | | 3/1984 |
| EP | 0 146 208 | A1 | 6/1985 |
| EP | 0258718 | | 3/1988 |
| EP | 0359421 | | 3/1990 |
| FR | 1010410 | | 6/1952 |
| FR | 2438983 | | 5/1980 |
| FR | 2507066 | | 12/1982 |
| FR | 2650488 | A1 | 2/1991 |
| GB | 1082382 | | 9/1967 |
| GB | 1214059 | | 12/1970 |
| GB | 1540926 | A | 2/1979 |
| GB | 2000676 | A | 7/1979 |
| GB | 2 032 761 | A | 5/1980 |
| GB | 2243530 | A | 6/1991 |
| JP | 62-200904 | | 12/1967 |
| JP | 48-57741 | | 8/1973 |
| JP | 48057741 | | 8/1973 |
| JP | 50116559 | | 9/1975 |
| JP | 50-116559 | | 9/1975 |
| JP | 61-37303 | | 10/1986 |

| | | | | | | |
|---|---|---|---|---|---|---|
| JP | 63-200703 | 8/1988 | | TW | 00157875 | 5/1991 |
| JP | 1-126903 | 5/1989 | | WO | WO- 8808263 A1 | 11/1988 |
| JP | 1-230302 | 9/1989 | | WO | WO- 8911047 A1 | 11/1989 |
| JP | 03-85103 | 4/1991 | | WO | WO- 9111926 A1 | 8/1991 |

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

The patentability of claims 12, 13, 15-17, 19, 20, 27, 28, 30-32, 35 and 36 is confirmed.

Claims 2, 3, 38-41, 45 and 48 were previously cancelled.

Claims 1, 4-11, 14, 18, 21-26, 29, 33, 34, 37, 42-44, 46, 47 and 49-92 are cancelled.

* * * * *